United States Patent [19]

Jackson

[11] Patent Number: 4,931,254

[45] Date of Patent: Jun. 5, 1990

[54] NB-TI-AL-HF-CR ALLOY

[75] Inventor: Melvin R. Jackson, Schenectady, N.Y.

[73] Assignee: General Electric Company, Schenectady, N.Y.

[21] Appl. No.: 290,399

[22] Filed: Dec. 29, 1988

[51] Int. Cl.[5] ..... C22C 27/02

[52] U.S. Cl. ..... 420/426

[58] Field of Search ..... 420/426

[56] References Cited

PUBLICATIONS

69(24) *Chem Abstracts* 98941e.

*Primary Examiner*—L. Dewayne Rutledge
*Assistant Examiner*—Margery S. Phipps
*Attorney, Agent, or Firm*—Paul E. Rochford; James C. Davis, Jr.; James Magee, Jr.

[57] ABSTRACT

An alloy having high strength at high temperature is provided. The alloy has a niobium base and has additives within the following ranges in atom percent:

Hf: 4–10
Al: 4–10
Ti: 5–18
Cr: 3–8

4 Claims, 1 Drawing Sheet

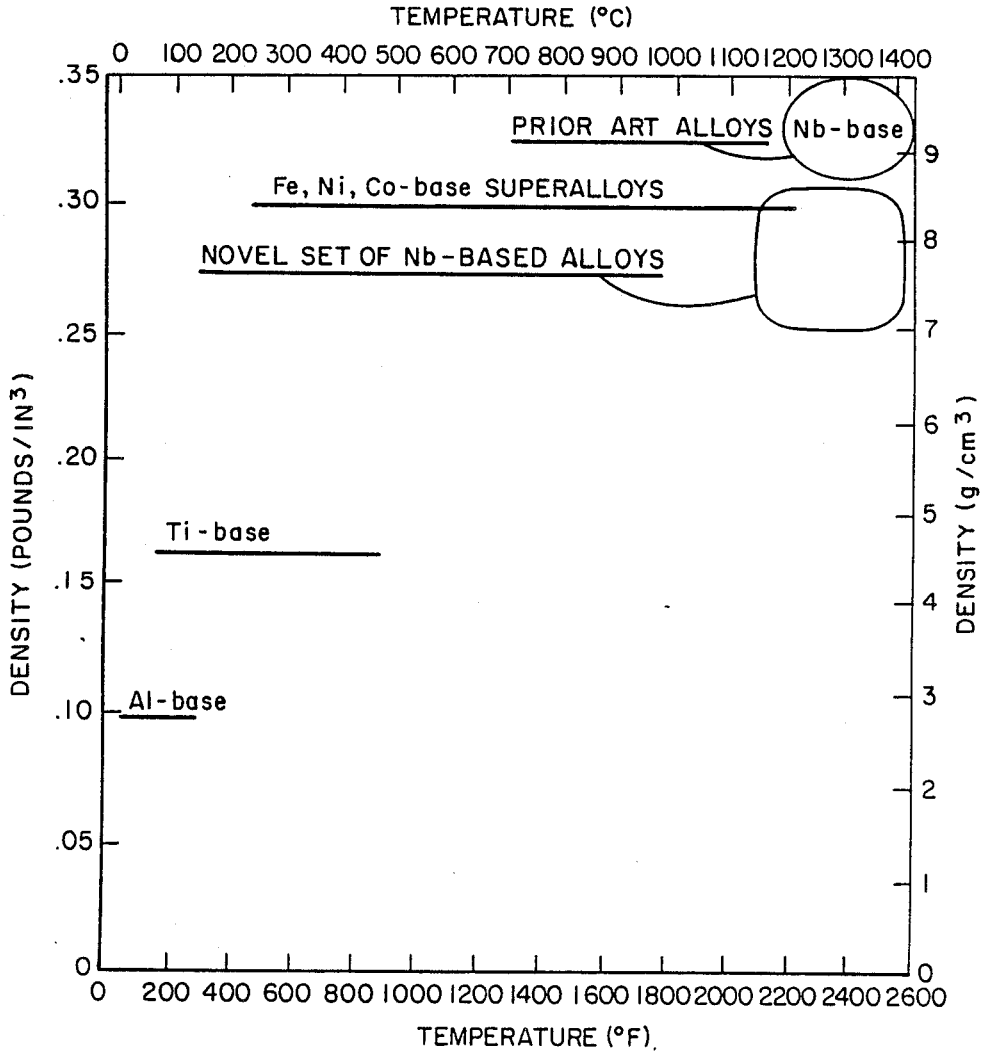
TEMPERATURE (°C)
0 100 200 300 400 500 600 700 800 900 1000 1100 1200 1300 1400
.35
.30
.25
.20
.15
.10
.05
0
DENSITY (POUNDS/IN³)
PRIOR ART ALLOYS
Nb-base
Fe, Ni, Co-base SUPERALLOYS
NOVEL SET OF Nb-BASED ALLOYS
Ti-base
Al-base
9
8
7
6
5
4
3
2
1
0
DENSITY (g/cm³)
0 200 400 600 800 1000 1200 1400 1600 1800 2000 2200 2400 2600
TEMPERATURE (°F)

NB-TI-AL-HF-CR ALLOY

CROSS REFERENCE TO RELATED APPLICATIONS

The subject application relates to application Ser. No. 202,357, filed June 6, 1988, now patent No. 4,877,576. It also relates to applications Ser. Nos. 280,085, 279,640, 279,639, filed Dec. 5, 1988. The test of the related application is incorporated herein by reference.

BACKGROUND OF THE INVENTION

The present invention relates generally to alloys and to shaped articles formed for structural use at high temperatures. More particularly, it relates to an alloy having a niobium base and which contains four additives. By a niobium base, it is meant that the principal ingredient of the alloy is niobium.

There are a number of uses for metals which have high strength at high temperature. One particular attribute of the present invention is that it has, in addition to high strength at high temperature, a modest density of the order of 7.2 to 8.2 grams per cubic centimeter (g/cc).

In the field of high temperature alloys and particularly alloys displaying high strength at high temperature, there are a number of concerns which determine the field applications which can be made of the alloys. One such concern is the compatibility of an alloy in relation to the environment in which it must be used. Where the environment is the atmosphere, this concern amounts to a concern with the oxidation or resistance to oxidation of the alloy.

Another such concern is the density of the alloy. One of the groups of alloys which is in common use in high temperature applications is the group of iron-base, nickel-base, and cobalt-base superalloys. The term "base", as used herein, indicates the primary ingredient of the alloy is iron, nickel, or cobalt, respectively. These superalloys have relatively higher densities of the order of 8 to 9 g/cc. Efforts have been made to provide alloys having high strength at high temperature but having significantly lower density. The alloys of the present invention have moderately lower density.

It has been observed that the mature metal candidates for use in this field can be grouped and such a grouping is graphically illustrated in the Figure. Referring now to Figure, the ordinate of the plot shown there is the density of the alloy and the abscissa is the maximum temperature at which the alloy provides useful structural properties for aircraft engine application. The prior art alloys in this plot are discussed in descending order of density and use temperatures.

With reference to the Figure, the materials of highest density and highest use temperatures are those enclosed within an envelope marked as Nb-base and appearing in the upper right hand corner of the figure. Densities range from about 8.7 to about 9.7 grams per cubic centimeter and use temperatures range from less than 2200° F to about 2600° F.

Referring again to the Figure, the group of prior art iron, nickel, and cobalt based superalloys are seen to have the next highest density and also a range of temperatures at which they can be used extending from about 500° F to about 2200° F.

A next lower density group of prior art alloys are the titanium-base alloys. As is evident from the figure, these alloys have a significantly lower density than the superalloys but also have a significantly lower set of use temperatures ranging from about 200° F to about 900° F.

The last and lowest density group of prior art alloys are the aluminum-base alloys. As is evident from the graph these alloys generally have significantly lower density. They also have relatively lower temperature range in which they can be used, because of their low melting points.

A novel additional set of alloys is illustrated in the figure as having higher densities than those of the titanium-base alloys, but having generally lower densities than those of the superalloys, but with useful temperature ranges extending beyond the superalloy temperature range. These ranges of temperature and density include those for the alloys such as are provided by the present invention and which are formed with a niobium base.

BRIEF STATEMENT OF THE INVENTION

It is, accordingly, one object of the present invention to provide an alloy system which has substantial strength at high temperature relative to its weight.

Another object is to reduce the weight of the elements presently used in higher temperature applications.

Another object is to provide an alloy which can be employed where high strength is needed at high temperatures.

Other objects will be in part apparent and in part pointed out in the description which follows.

In one of its broader aspects, these and other objects of the present invention can be achieved by providing a niobium base alloy having additives as follows:

| Ingredient | Concentration in Atomic % | |
|---|---|---|
| | From | To |
| niobium | balance essentially | |
| hafnium | 4 | 10 |
| aluminum | 4 | 10 |
| titanium | 5 | 18 |
| chromium | 3 | 8 |

The phrase balance "balance essentially" as used herein includes, in addition to the niobium in the balance of the alloy, small amounts of impurities and incidental elements, which in character and/or amount do not adversely affect the advantageous aspects of the alloy.

BRIEF DESCRIPTION OF THE DRAWING

The description which follows will be understood with greater clarity with references made to the accompanying drawing in which:

The Figure is a graph depicting the relationship between density and operating temperature for a number of alloy families. These alloys extend from the low temperature/low density aluminum alloys to the high temperature/high density niobium base alloys.

DETAILED DESCRIPTION OF THE INVENTION

With reference again now to the Figure, the alloys of the present invention have densities and use temperatures which fall within the area plotted in the figure. It is evident that the density of the alloys is about equal to or may be considerably less than that of the iron, nickel and cobalt base superalloys. The use temperature of these alloys extends above the upper range of use temperatures of the superalloys. Use temperatures extend from about 2000° F to over 2500° F. The alloys themselves and their properties are considered in the examples below.

EXAMPLES 1 and 2

Three alloys were prepared to have compositions according to the present invention with densities of 7.2 and 8.2. The composition of these alloys is set forth in Table I immediately below.

TABLE I

| Example | Concentration in Atom % | | | | | Density |
|---|---|---|---|---|---|---|
| | Nb | Hf | Al | Ti | Cr | |
| 1 | 65 | 10 | 12 | 5 | 8 | 8.0 |
| 2 | 55 | 5 | 15 | 15 | 10 | 7.2 |
| 3 | 60 | 8 | 12 | 10 | 10 | 7.7 |

The samples were prepared by arc melting in a water-cooled hearth. In addition, conventional tensile bars were prepared from the samples for tensile testing. Tests were conducted and the results obtained are discussed below.

The alloy of Example 1 was tested at 980° C and found to have a tensile strength of 44 ksi at this test temperature. However, the alloy had no measurable ductility. The absence of ductility was deemed to be due to the relatively high aluminum concentration and particularly to the relatively high concentration of aluminum in relation to the solubility of aluminum in the composition.

With respect next to Example 2, the test bars prepared from this alloy were also tested. Tests at 980° C revealed tensile strength of 20.1 ksi but, again, no measurable ductility. A test of a bar at 1200° C revealed a yield strength of 17.8 ksi and an elongation of 26%. This is a very significant strength at 1200° C. The low-density compositions which can achieve such high temperature strength are indeed unique.

However, the preferred compositions of this invention are those which have somewhat lower strength properties but which have some ductility at the higher temperatures as well as at lower temperatures. These compositions are those with the lower aluminum concentrations.

Also, these are compositions which have higher titanium concentrations as the presence of higher titanium concentrations favors the solubility of aluminum and the alloys which have higher aluminum concentrations are those with more desirable ductility levels.

Accordingly, the compositions which are desirable and those which are preferred are those having the following approximate alloy content:

TABLE II

| Composition | Composition in Atom Percent of Alloys Having High Strength at High Temperatures | | | | |
|---|---|---|---|---|---|
| | Nb | Hf | Al | Ti | Cr |
| A | balance | 4–10 | 4–10 | 5–18 | 3–8 |
| B | balance | 4–7 | 4–7 | 12–18 | 3–6 |

From the table, it is evident that a higher level of titanium and lower level of aluminum is contemplated. In this regard, the alloys having the higher concentrations of aluminum should not include only the lower concentrations of titanium. In this regard, the alloy of Example 2 which had higher titanium of 15 atom percent would be a more desirable alloy if the aluminum were within the range set out in Table II. Favorable alloys can be formed with aluminum concentrations of 4 to 10 atom percent where the titanium concentration is correspondingly high. A preferred range for the aluminum is 4 to 7 atom percent as set out in composition B. Please note that the preferred composition B has high titanium concentrations of 12 to 18 atom percent.

What is claimed is:

1. An alloy having high strength at high temperature which comprises an alloy consisting essentially of the following composition in atom percent:

| Ingredient: | Nb | Hf | Al | Ti | Cr |
|---|---|---|---|---|---|
| Percentages: | 54–84 | 4–10 | 4–10 | 5–18 | 3–8 |

2. The alloy of claim 1, in which the aluminum is 4–7 and the titanium is 13–18.

3. An alloy having high strength at high temperature which comprises an alloy consisting essentially of the following composition in atom percent:

| Ingredient: | Nb | Hf | Al | Ti | Cr |
|---|---|---|---|---|---|
| Percentages: | 62–77 | 4–7 | 4–7 | 12–18 | 3–6 |

4. The alloy of claim 3, in which the aluminum is 4–5 and the titanium is 15–18.

* * * * *